US012379176B2

(12) United States Patent
Malichen-Snyder

(10) Patent No.: US 12,379,176 B2
(45) Date of Patent: Aug. 5, 2025

(54) REMOTELY ACTIVATED FIREARM ACCESSORY

(71) Applicant: Thomas Joseph Malichen-Snyder, Kingston (CA)

(72) Inventor: Thomas Joseph Malichen-Snyder, Kingston (CA)

( * ) Notice: Subject to any disclaimer, the term of this patent is extended or adjusted under 35 U.S.C. 154(b) by 0 days.

(21) Appl. No.: 18/473,488

(22) Filed: Sep. 25, 2023

(65) Prior Publication Data

US 2024/0011728 A1 Jan. 11, 2024

Related U.S. Application Data

(63) Continuation-in-part of application No. 17/367,819, filed on Jul. 6, 2021, now Pat. No. 11,774,199.

(51) Int. Cl.
*F41A 17/06* (2006.01)

(52) U.S. Cl.
CPC ..... *F41A 17/063* (2013.01)

(58) Field of Classification Search
CPC ..... F41A 17/06; F41A 17/56
USPC ..... 42/70.11, 70.01, 70.06, 70.07
See application file for complete search history.

(56) References Cited

U.S. PATENT DOCUMENTS

2014/0230300 A1* 8/2014 Haq ..... F41A 17/54 42/70.06
2014/0290110 A1* 10/2014 Stewart ..... F41A 17/46 42/70.11
2014/0360073 A1* 12/2014 Stewart ..... F41A 17/08 42/70.11
2023/0010591 A1* 1/2023 Malichen-Snyder ... F41A 17/54

* cited by examiner

*Primary Examiner* — Samir Abdosh

(57) ABSTRACT

The invention relates to an electronic device that is used to block the accessibility of a firearms Trigger. Wherein an electronic device is mounted on a rail or rail accessory and is locked in place using a lock and frame allowing the device to fit an array of firearms. The lock and frame are in place to stop easy removal unless the possessor has the key to remove them. The device its self uses a battery to operate and picks up or sends a broadcasted transmission within a programmed range by the use of a printed circuit board (PCB) capable of receiving or sending a broadcasted transmission. Once the transmission has been picked up or sent and received it activates the electronic devices locking mechanism in the form of a electromechanical mechanism causing it to shift and allows a slide placed in front of the trigger acting as a second trigger to move back and forth allowing the movement of the firearms trigger. The slide is moved back into its original position by the use of a spring driven mechanism. When the worn device or the electronic device is out of the programmed range, the electromechanical mechanism returns to its locked state stopping access to the trigger. Making the trigger locking device a beneficial reusable safety device.

13 Claims, 10 Drawing Sheets

REMOTELY ACTIVATED FIREARM ACCESSORY

BACKGROUND OF THE INVENTION

Field of the Invention

The invention generally relates too a firearm safety device in the form of a self-locking slide acting as a second trigger, mounted in front, against the sides, and behind the firearms trigger by the use of a rail or rail accessory allowing compatibility to a wide variety of firearms. It is activated by proximity detection picking up a broadcast transmission signal within a certain range, thus signaling a electromechanical mechanism to shift allowing the user to pull the slide that was acting as a second trigger denying access to the firearms trigger, against the firearms trigger discharging their firearm. A spring assists the slide acting as the second trigger back into position when the trigger is released or not under pressure. The devices electromechanical mechanism relocks the use of the slide acting as a second trigger when the worn device is out of the proximity detections set predetermined range.

Background

Some attempted solutions have tried finger print detection, barrel locks that discharge with a turning combination and RFID embedded hand grips that control the firing pins, but this has not sufficiently addressed the needs of the firearms safety industry owing to the needed modifications to the gun, usability issues such as only being compatible with a few models, or the lock was designed to discharge or fall off providing no lasting safety from someone else using the owners weapon against them.

SUMMARY

This invention relates to a method and means of a trigger locking device for firearm safety purposes. This trigger locking device uses electronic, electromechanical and mechanical parts. The device works by the use of proximity detection, a electromechanical mechanism, a switch and spring-loaded slide that acts as an open trigger cover obstructing the trigger allowing your trigger to be accessible with the ability to put your finger around it but inoperable. The device is powered by rechargeable batteries. The printed circuit boards (PCB) capable of proximity detection also operates the electromechanical mechanism and unlocks it indefinitely until the wrist worn devices broadcast transmission is broken or the accessories transmission is broken between the wrist worn device at which point the electromechanical mechanism would relock the spring-loaded slide again. The proximity detection connects between the trigger locking device and the worn device owned by the user, and will connect within a predetermined distance of a foot or less of each other. The device as a whole has a switch to turn on and off or partly turn off. Once on the printed circuit boards (PCB) proximity detection will indefinitely search for its pre-set device's connection. The printed circuit boards (PCB) proximity detection will only be programmed to operate the electromechanical mechanism when the device being used specifically for the firearms safety device is in range, stopping the possibility of other transmission broadcasting devices from interfering or unlocking the slide controlling the trigger on the firearm. The device is attached to a firearm though the use of a gun rail, or gun rail attachment, it is then locked with a key and frame covering itself and the firearm, thus making removal without its key extremely difficult.

The purpose of this Invention is safety. One main advantage of the invention is to protect concealment or open carry users, particularly in civilian use, from being hurt by their own firearm. For example, someone where to attack a carrier overpower them and take control of their firearm, or the carrier drew their weapon but decided not to shoot and the attacker gained control of the weapon, the carrier could decide to run or fight while the attacker tried to operate their weapon unsuccessfully, thus potentially saving ethers lives. Another advantage is around young children the device would be inoperable without serious intent and knowledge of operation, time, effort, and resources not typical of young children. These are just some examples of its purpose and benefits however one large advantage that should be empathized is animosity, this device and its user's compatible wrist worn device are chosen by the user alone and selected through their devices app. The device can be disconnected at their choosing at any time, it is merely capable of stopping the ability to pull a trigger and can be removed from the rail of the firearm or rail accessory on the firearm at any time using the key provided if they can't gain electronic access. This invention is meant to operate on all sorts of firearms giving it a wide array of compatibility.

DETAILED DESCRIPTION OF DRAWINGS

Figure 1:
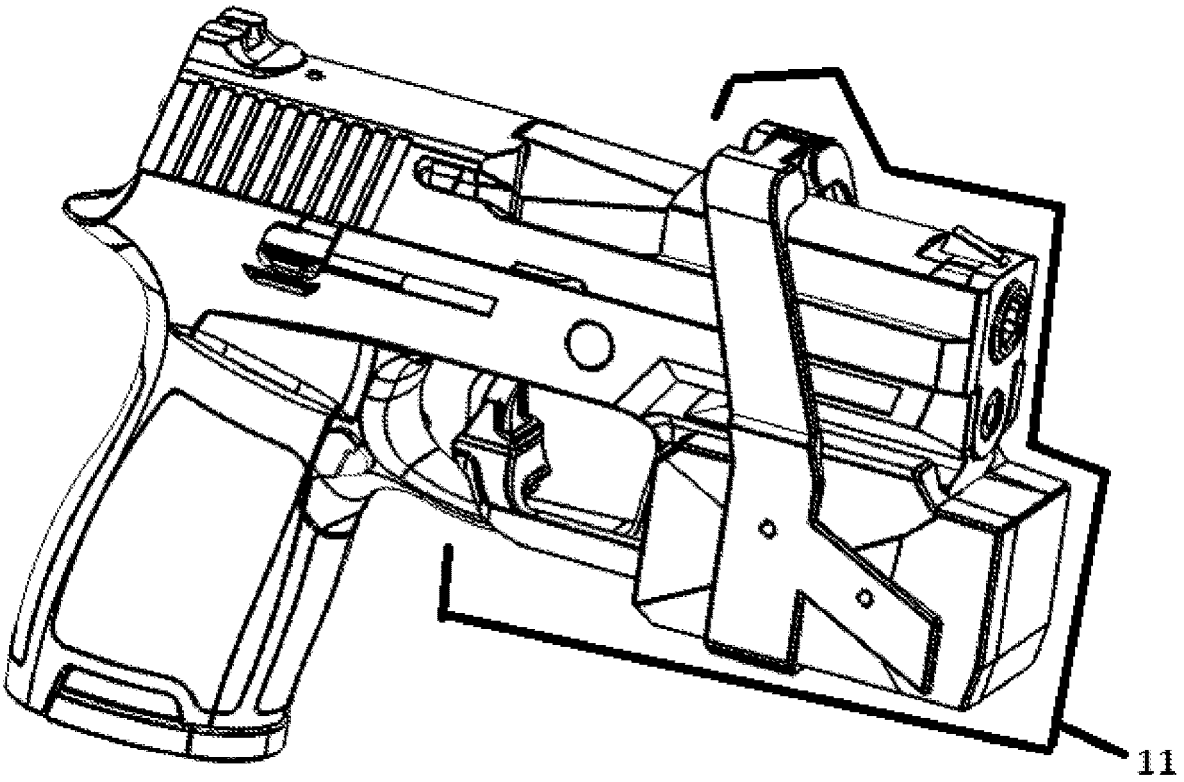
FIG. 1 depicts the device attached to a firearm rail.
Figure 2:
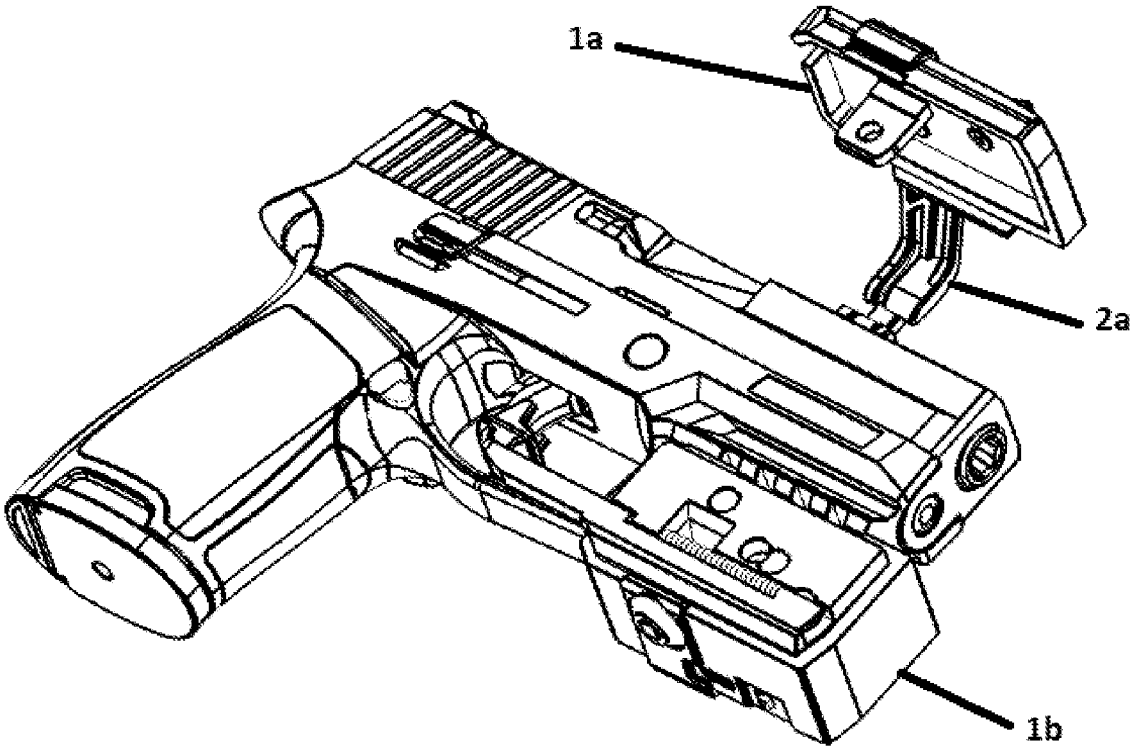
FIG. 2 depicts a perspective view of the device not fully closed and locked around the firearm.
Figure 3:
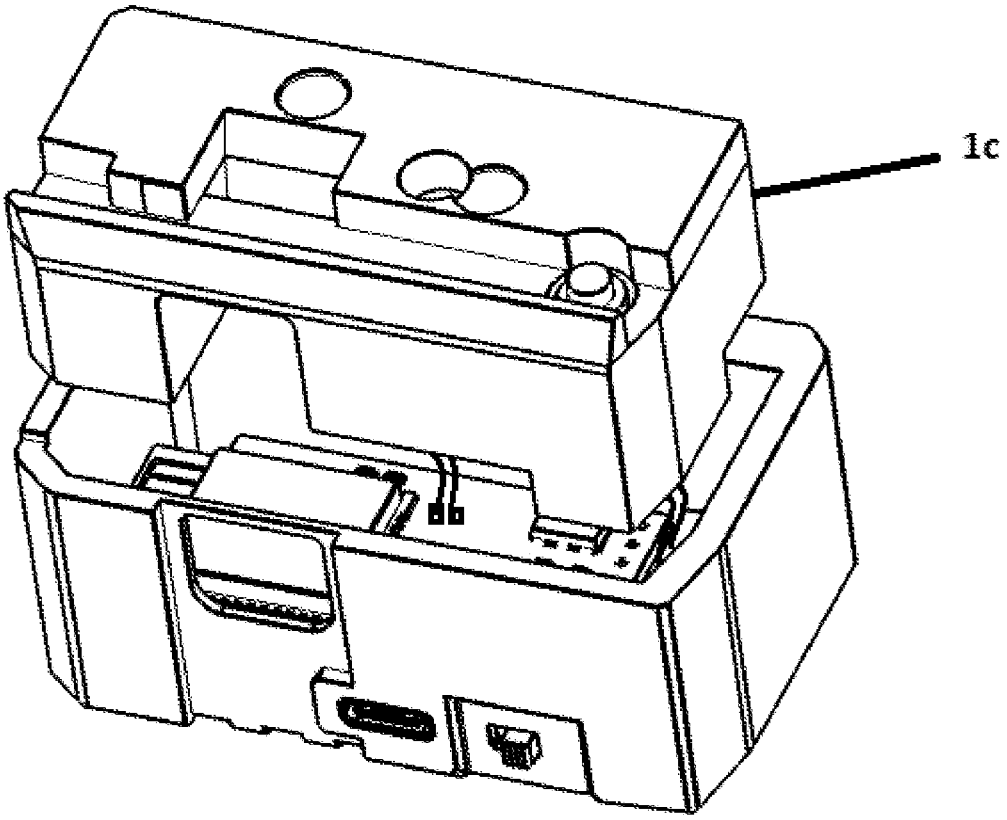
FIG. 3 depicts the internal casing being placed into the external casing.
Figure 4:
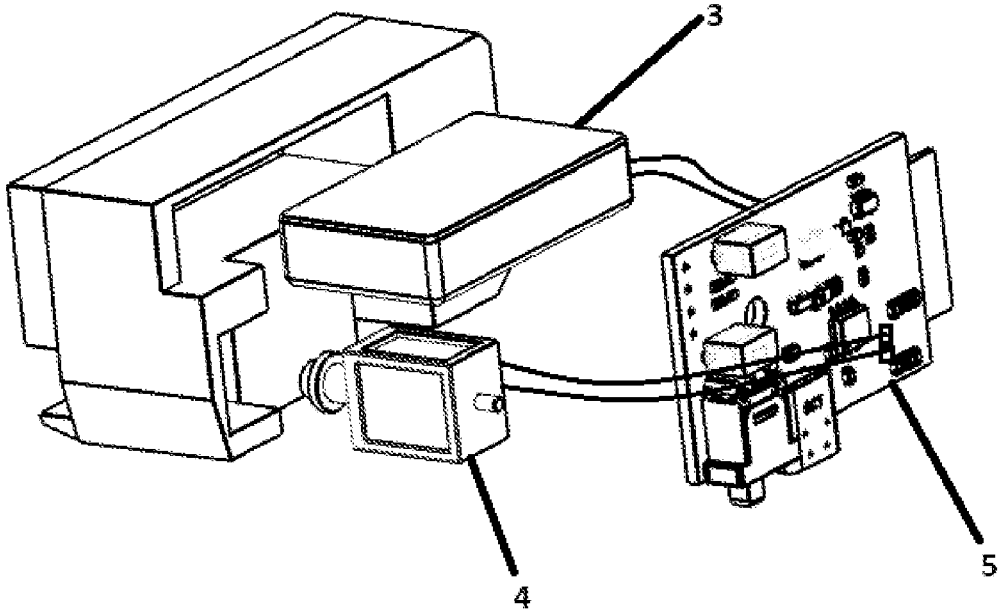
FIG. 4 depicts the main electromechanical mechanism and the electronic components of the device being placed into internal casing.
Figure 5:
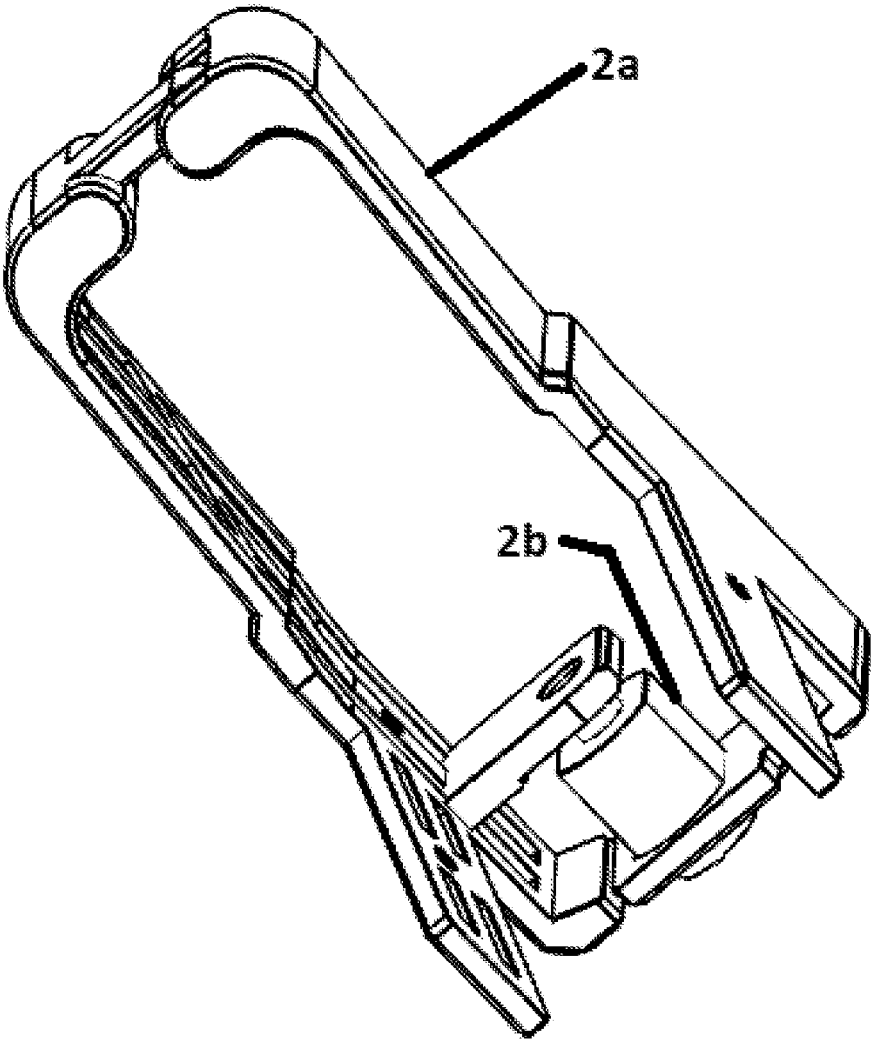
FIG. 5 depicts the frame and non electronic lock of the device.
Figure 6:
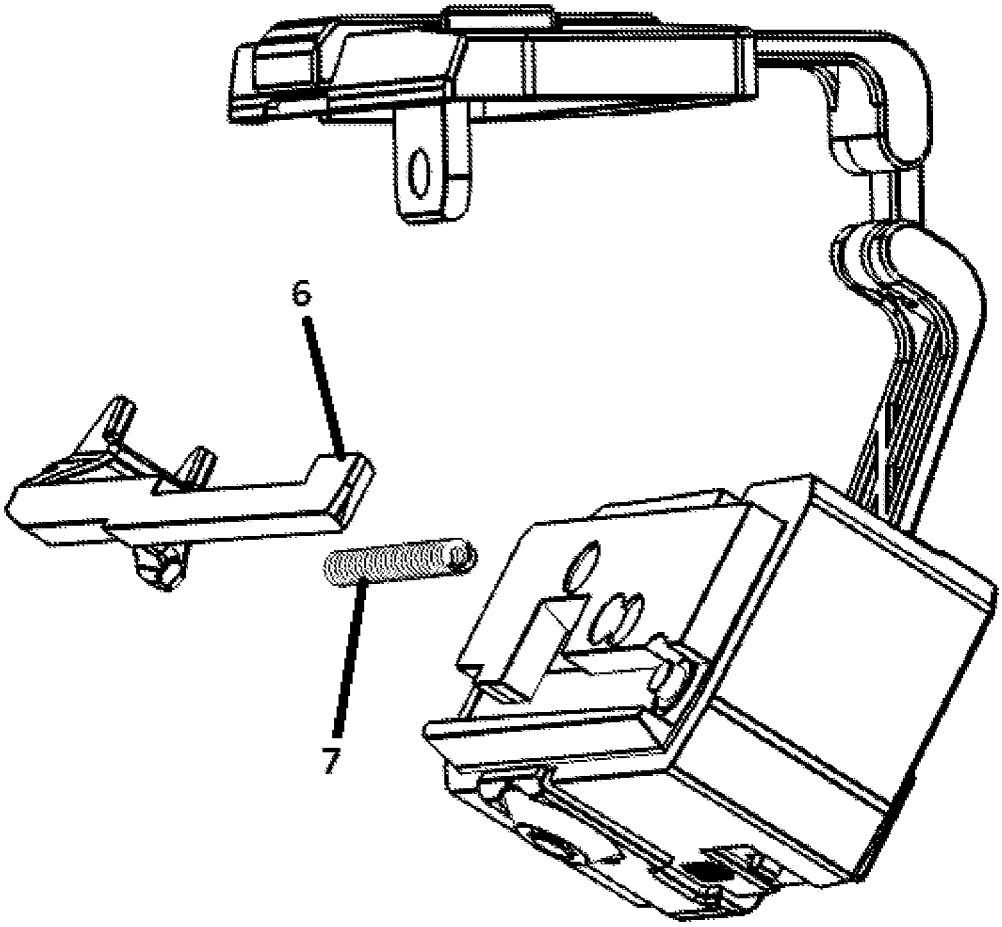
FIG. 6 depicts the device with the spring and slide exposed.
Figure 7:
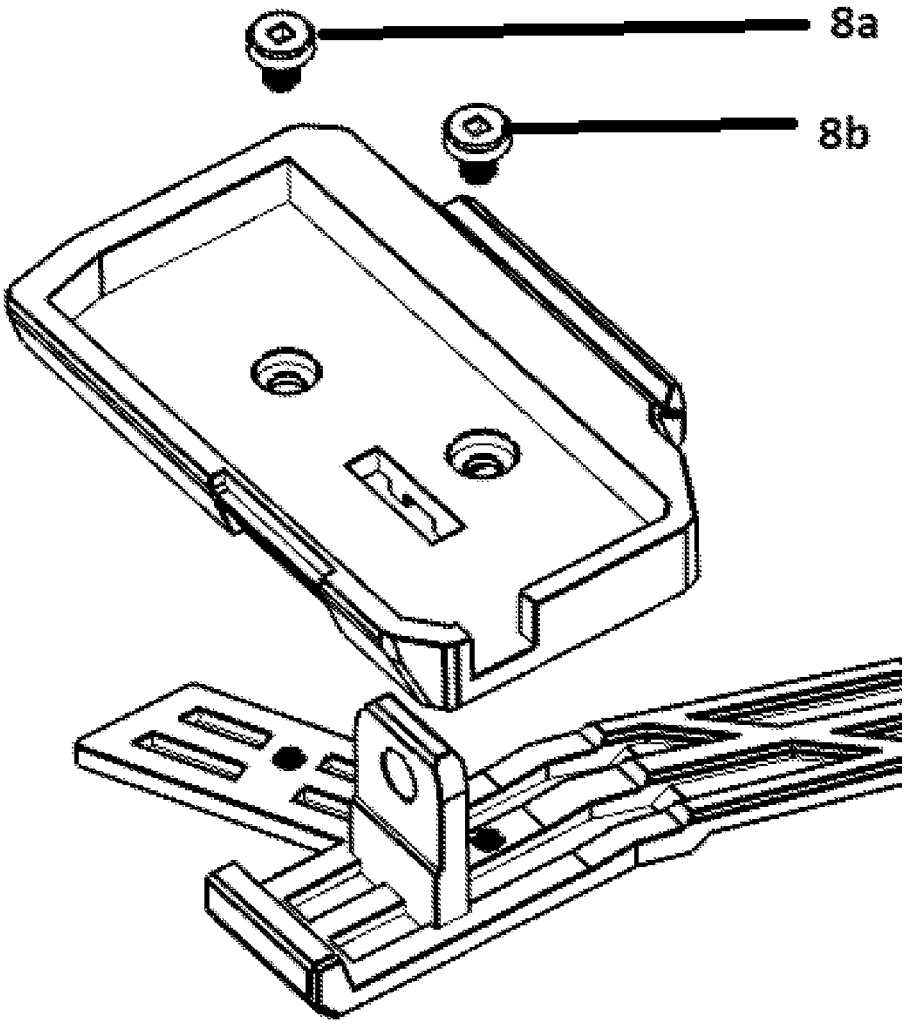
FIG. 7 depicts a piece of the devices casing and where it is fastened on its inner side to the frame using screws.
Figure 8:
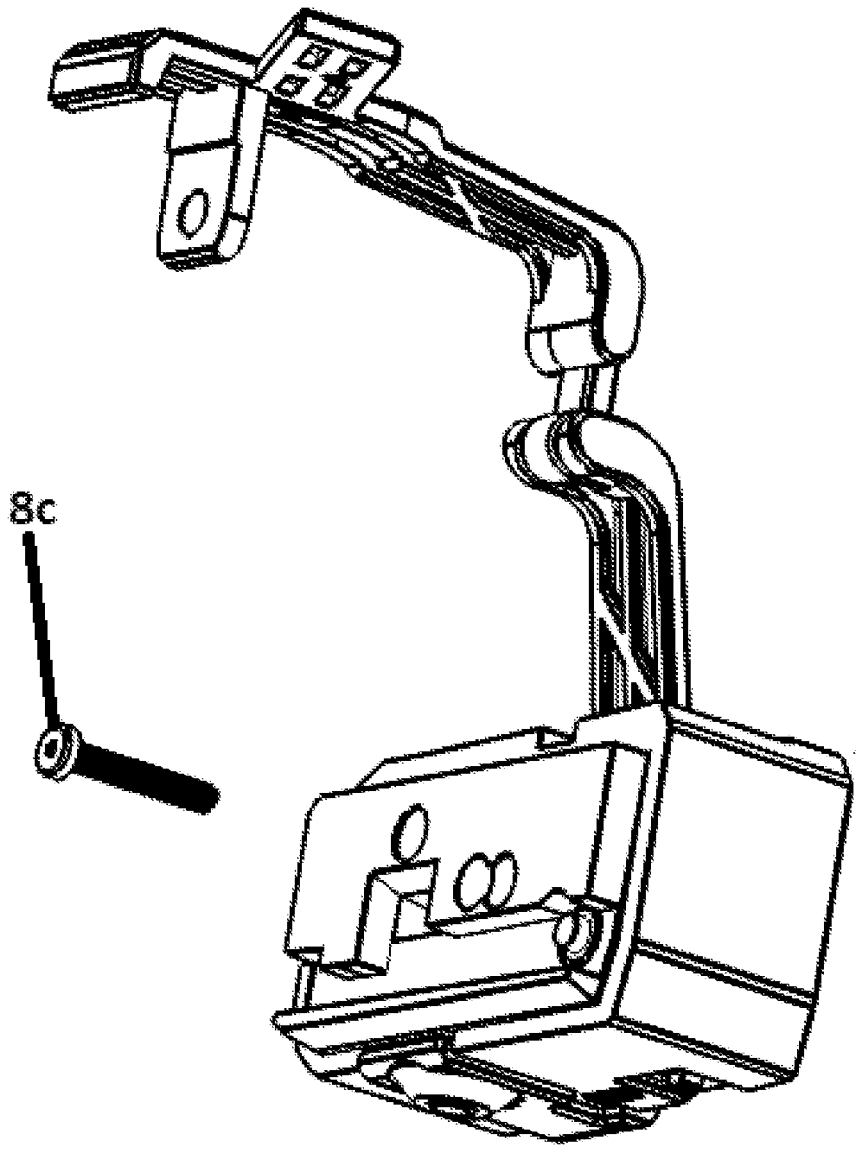
FIG. 8 depicts how the internal casing is fastened into the device and subsequently frame internally using screws.
Figure 9:
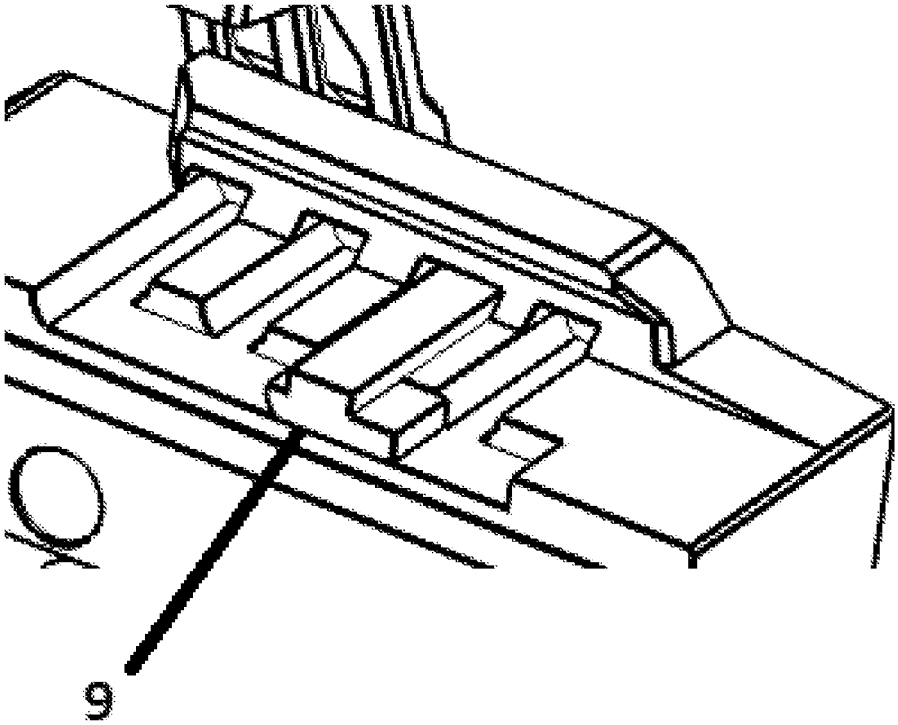
FIG. 9 depicts one of the rail slots on the device holding a pin.
Figure 10:
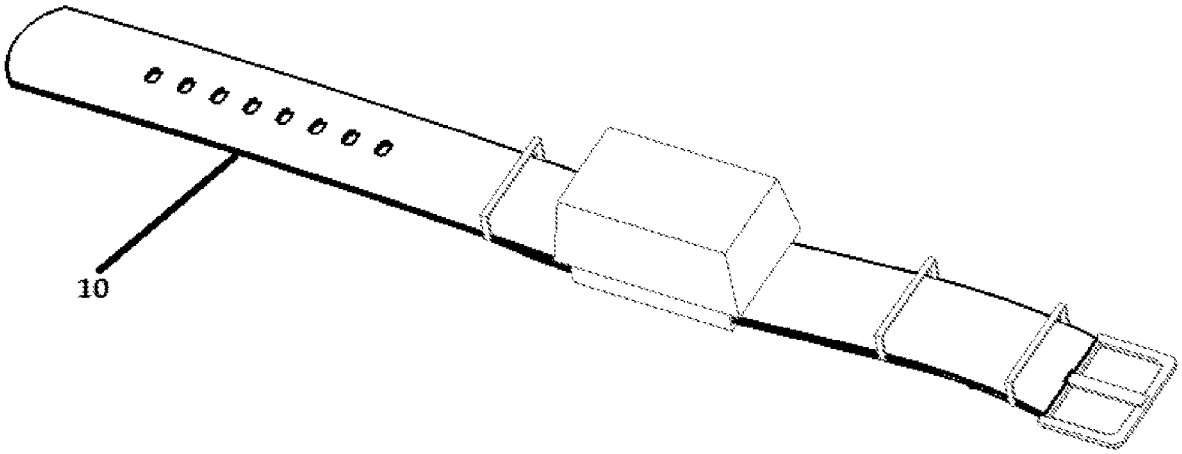
FIG. 10. Depicts a wrist worn device.

The device 11 (FIG. 1) comprises casing consisting of three pieces 1*a*, 1*b*, 1*c* (FIGS. 2 and 3). A electromechanical mechanism 4, a printed circuit board (PCB) 5, and a battery 3 (FIG. 4), are placed inside the internal casing 1*c* (FIG. 3) and is then placed into an external piece of casing acting as the container 1*b* (FIG. 2). A frame 2*a* and a lock welded to the frame 2*b* (FIGS. 2 and 5) is then inserted inside the internal casing 1*c* and around the external casing acting as the container 1*b*. a screw 8*c* (FIG. 8) is then screwed threw the internal casing 1*c*, through a mounting hole in the printed circuit board (PCB) 5, through the inside casing of 1*b*, and into the frame 2*a* securing the pieces together. Two screws 8*a* and 8*b* (FIG. 7) are then screwed to the inward face of the casing 1*a* to the frame 2*a* securing the final piece of casing acting as a cover with the frame 2*a*. A slide 6 and a spring 7 (FIG. 6) are then placed in the space provided in the internal casing 1*c*. A pin 9 (FIG. 9) is then placed in one of the spaces provided within the external casing of 1*b* to secure the device to the firearm. To properly operate said device the wrist worn device 10 (FIG. 10) is placed on the hand you draw your gun with.

I claim:

1. A firearm trigger locking accessory comprising: a slide which protrudes from a housing extending out to cover the trigger from the front, the right side, the left side, and the back side, while still allowing access within the trigger guard, said slide being permanent or interchangeable; a printed circuit board (PCB) capable of sending or receiving broadcasted radio transmissions and activating an electromechanical mechanism, a power source, a switch configured to control or partially control said printed circuit board (PCB), an electromechanical mechanism involved in locking and unlocking said slide; a spring driven mechanism to assist moving said slide back into its lockable position; a means of attaching the housing onto a firearm by the use of a rail or rail accessory; and a frame, extending over the firearm, configured to secure the accessory in place and lock with a key.

2. The Firearm trigger locking accessory of claim 1 wherein said firearm trigger locking accessory's printed circuit board (PCB) is capable of detecting broadcasting radio transmissions.

3. The firearm trigger locking accessory of claim 2 wherein said firearm trigger locking accessory's printed circuit board (PCB) is capable of determining the distance of said broadcasted radio transmissions.

4. The firearm trigger locking accessory of claim 1, claim 2, or claim 3 wherein said firearm trigger locking accessory's printed circuit board (PCB) is capable of receiving or sending broadcast transmissions from Radio Frequency Identification (RFID) technology.

5. The firearm trigger locking accessory of claim 1, claim 2, or claim 3 wherein said firearm trigger locking accessory's printed circuit board (PCB) is capable of receiving or sending broadcast transmissions from Bluetooth Low Energy (BLE) technology.

6. The firearm trigger locking accessory of claim 1, claim 2, or claim 3 wherein said firearm trigger locking accessory's printed circuit board (PCB) is capable of receiving or sending broadcast transmissions from Wireless Fidelity (Wi-Fi) technology.

7. The firearm trigger locking accessory of claim 1, claim 2, or claim 3 wherein said firearm trigger locking accessory's printed circuit board (PCB) is capable of receiving or sending broadcast transmissions from Near Field Communication (NFC) technology.

8. The firearm trigger locking accessory of claim 1, claim 2, or claim 3 wherein said firearm trigger locking accessory's printed circuit board (PCB) is capable of receiving or sending broadcast transmissions from ultra-Wideband (UWB) technology.

9. The firearm trigger locking accessory of claim 1, claim 2, or claim 3 wherein said firearm trigger locking accessory's printed circuit board (PCB) is capable of receiving or sending broadcast transmissions from Zigbee low power wireless technology.

10. The firearm trigger locking accessory of claim 1 wherein said electromechanical mechanism is an electromagnetic actuator.

11. The firearm trigger locking accessory of claim 1 wherein said electromechanical mechanism is a DC motor.

12. The firearm trigger locking accessory of claim 1 wherein said electromechanical mechanism is a servo motor.

13. The firearm trigger locking accessory of claim 1 wherein said electromechanical mechanism is a stepper motor.

* * * * *